US006779869B2

(12) United States Patent
Hendricks et al.

(10) Patent No.: US 6,779,869 B2
(45) Date of Patent: Aug. 24, 2004

(54) PRINTHEAD NOZZLE ALIGNMENT IN A PRINTING SYSTEM

(75) Inventors: Jeffrey T. Hendricks, Camas, WA (US); Si-Lam Choy, Corvallis, OR (US); Ronald A. Hellekson, Eugene, OR (US); John M. Altendorf, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 188 days.

(21) Appl. No.: 10/066,065

(22) Filed: Jan. 31, 2002

(65) Prior Publication Data

US 2003/0143008 A1 Jul. 31, 2003

(51) Int. Cl.[7] ..... B41J 23/00
(52) U.S. Cl. ..... 347/37

(58) Field of Search ..... 347/4, 8, 37, 49, 347/85, 86, 87, 91, 108, 40, 41, 42, 43; 400/140, 141, 11, 352, 354

(56) References Cited

U.S. PATENT DOCUMENTS 5,332,321 A 7/1994 Beauchamp et al. ..... 400/354
5,366,305 A 11/1994 Christianson ..... 400/354
6,386,681 B1 * 5/2002 Askren et al. ..... 347/49

* cited by examiner

*Primary Examiner*—Hai Pham

(57) ABSTRACT

The present invention relates to a carriage for use in a printing device, the carriage including a carriage body with a bearing structure configured to support such carriage body for movement along a reference track. The carriage also includes a printhead anchored to the carriage body, and aligned directly relative to the carriage bearing structure.

16 Claims, 3 Drawing Sheets

PRINTHEAD NOZZLE ALIGNMENT IN A PRINTING SYSTEM

BACKGROUND OF THE INVENTION

In printing systems, such as in inkjet printing systems, one consideration of system design involves the alignment of the printhead nozzles accurately with regard to the scan-axis carriage positioning guide, typically a precision-ground, cylindrical rod or rail. In particular, it is intended that the printhead nozzles be accurately and stably aligned, ultimately, relative to the body of the supporting carriage which rides on this rail, and therefore, accurately and stably also with respect (both translationally and rotationally) to all three of the usual, three, mutually orthogonal reference axes that are associated with the carriage-rail-supporting frame in a printer. Alignment relative to the X axis herein refers specifically to locked alignment relative to the body of the carriage, recognizing that the carriage must move back and forth in the X direction during printing. The carriage is also conventionally permitted a certain amount of rocking about the X axis to deal with printhead print height matters.

The three reference axes—the X axis which extends (as just indicated) in the printhead scanning direction, the Y axis which extends generally in the direction that print media is advanced through the printzone in the printer, and the upright Z axis—all typically are carefully respected with regard to proper nozzle alignment so as to achieve, from that perspective, the highest possible printing quality. In the many and various printing systems which have existed in the art to date, this issue of aligning has continued to present challenges—challenges that relate to economy of manufacture, to maintenance and preparation of close tolerances, to minimizing the number of datuming regions that may be distributed in the carriage/pen/ink-supply interface structure, and to other things.

In relation to known alignment of printhead nozzles with respect to the carriage body in a printer, tolerances exist in what often constitutes an additive-error stack of tolerance interfaces which results from the presence of plural, successive datuming interfaces that co-exist between the printhead nozzles and the bearings which support the carriage body on the supporting carriage rail. This "tolerance stack" (sometimes referred to as a tolerance loop) is a potential, and often real, contributor to misalignment problems.

SUMMARY OF THE INVENTION

The present invention relates to a carriage for use in a printing device, the carriage including a carriage body with a bearing structure configured to support such carriage body for movement along a reference track. The carriage also includes a printhead anchored to the carriage body, and aligned directly relative to the carriage bearing structure.

DETAILED DESCRIPTION OF THE INVENTION

Figure 1:
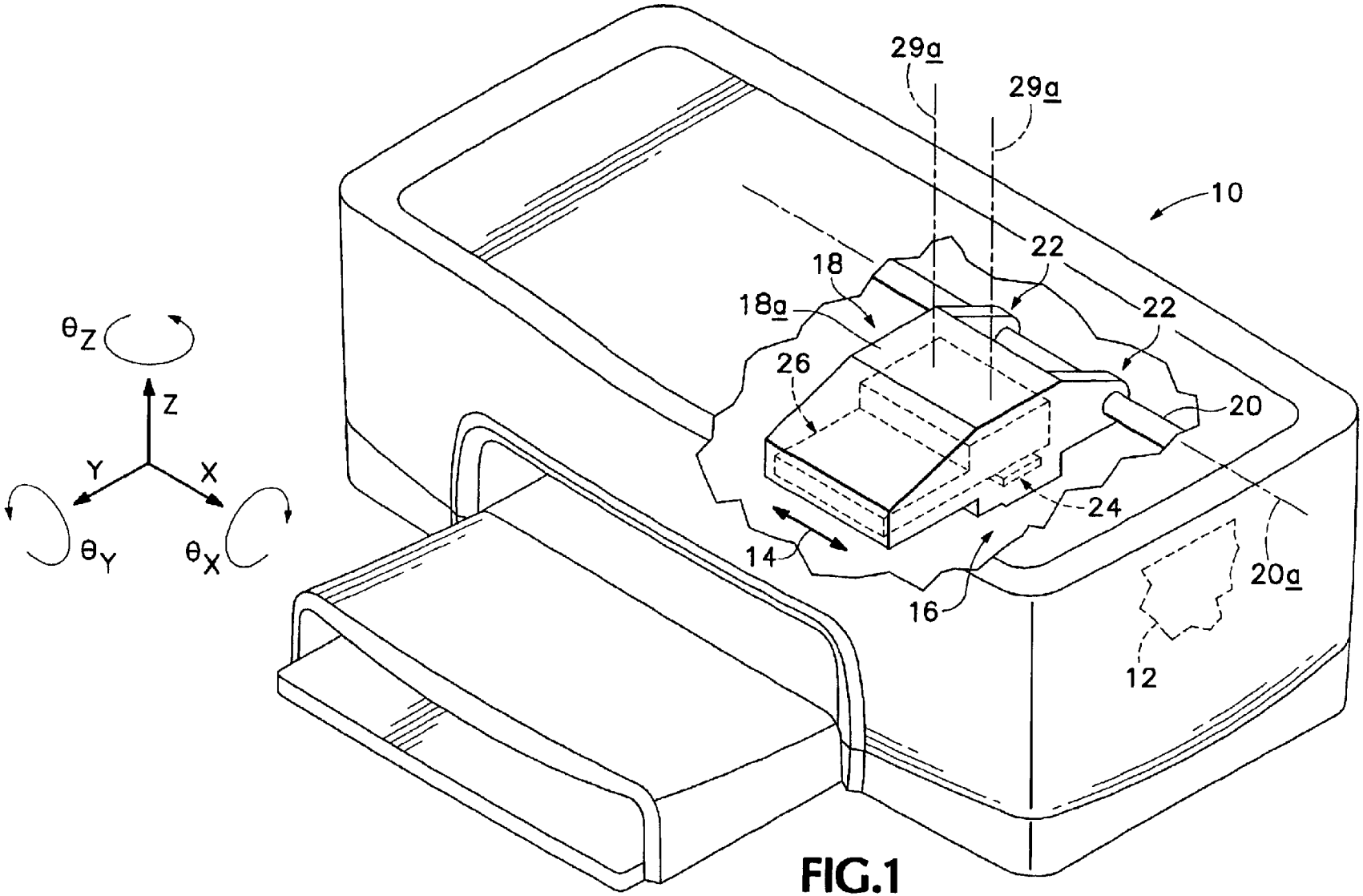
FIG. 1 is a top isometric view illustrating portions of an inkjet printer which employs alignment structure and methodology in accordance with one embodiment of the present invention.

Turning attention now to all figures in the drawings, indicated generally at 10 is an inkjet printer which incorporates one embodiment of the present invention, and which is based upon one manner of practicing the methodology of the present invention. It is to be appreciated that although printer 10 takes the form of a stand-alone inkjet printer, the present embodiment of the invention may be employed in a variety of printing devices, including copiers, facsimile machines, etc.

Included in printer 10, and indicated just fragmentarily in dashed lines at 12 in FIG. 1, is a frame with respect to which there may be associated mutually orthogonally-related reference axes, referred to herein as a foundation set of axes. Such reference axes are pictured in relation to one another in a graphical presentation at X, Y and Z toward the left side of FIG. 1.

As indicated, in printer 10, the X axis extends generally in the printhead scanning direction, which is indicated by double-ended arrow 14, the Y axis extends generally along a line which is in the direction of paper, or print-media, advance through the printzone 16, and the Z axis extends generally vertically. These three reference axes typically directly relate to translational positioning, alignment or adjustment of structure associated with printer 10.

Associated with each of these three translational axes is a rotation which relates to rotational positioning, alignment or adjustment that may also be accomplished by the apparatus and methodology of the present embodiment of the invention. With respect to axis X, this rotational characteristic is shown at $\theta x$, with respect to the Y axis, the characteristic is shown at $\theta y$, and with respect to the Z axis, at $\theta z$.

Further included in printer 10 is a carriage, or carriage means 18, having a carriage body 18*a* which is mounted, through appropriate spaced bearing structures, for riding back and forth generally in the reversible directions indicated by previously-mentioned double-ended arrow 14. Specifically, carriage 18 may be mounted for such movement on and along a reference track such as elongate carriage rail 20. As will be appreciated by those skilled in the art, opposite ends of carriage rail 20 may be suitably anchored, and thereby datumed, to frame 12. Such datuming for the carriage rail locks the rail in place relative to all three of the reference axes in printer 10, and also with respect to all three of the rotational motions that are associated with those three axes. The long axis of carriage rail 20 is shown at 20*a*. This axis parallels the X reference axis in FIG. 1.

Bearing structure which directly supports the carriage body on rail 20 may either be separate bearing structure which is suitably interposed these two structures, or it may be structure which is formed integrally in and with carriage body 18*a*. This bearing structure generally resides in the locations pointed to by arrows 22 in FIGS. 1, 2 and 3. A variety of suitable bearing structures may be used such as that shown in U.S. Pat. No. 5,366,305 to Christianson, which is commonly owned by the current assignee, Hewlett-Packard Company of Palo Alto, Calif.

Figure 2:
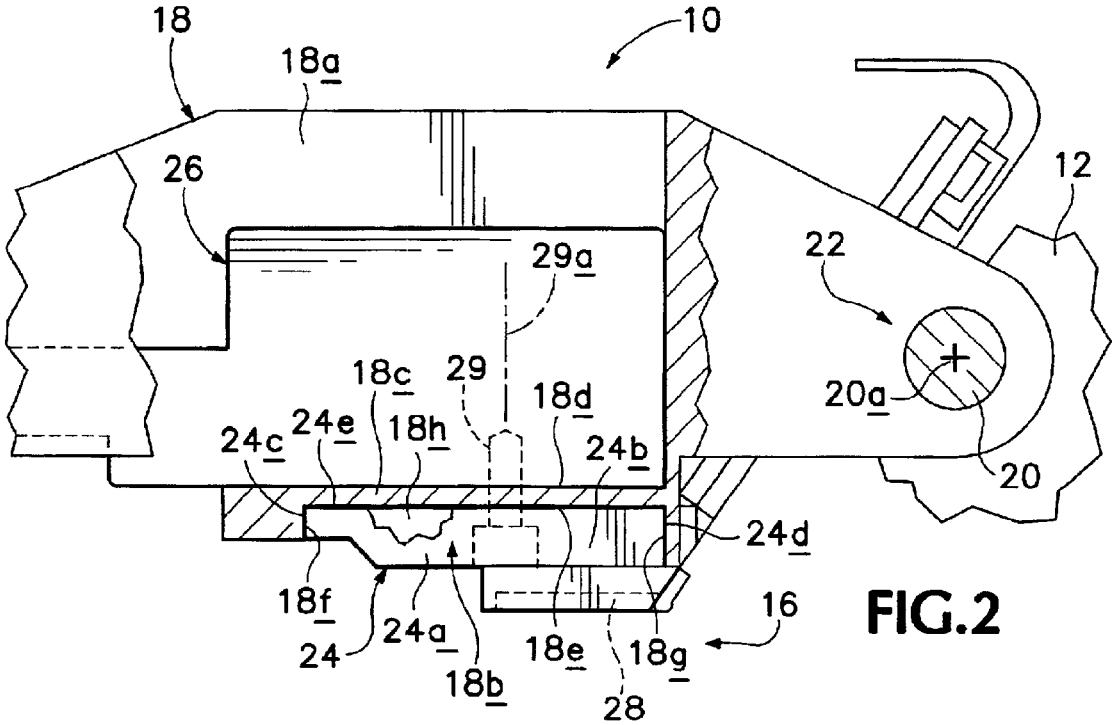
FIG. 2 is a larger-scale isolated and fragmentary view of a carriage, a printhead carrier, and an ink-supply system taken generally along the line 2—2 in FIG. 1.
Figure 3:
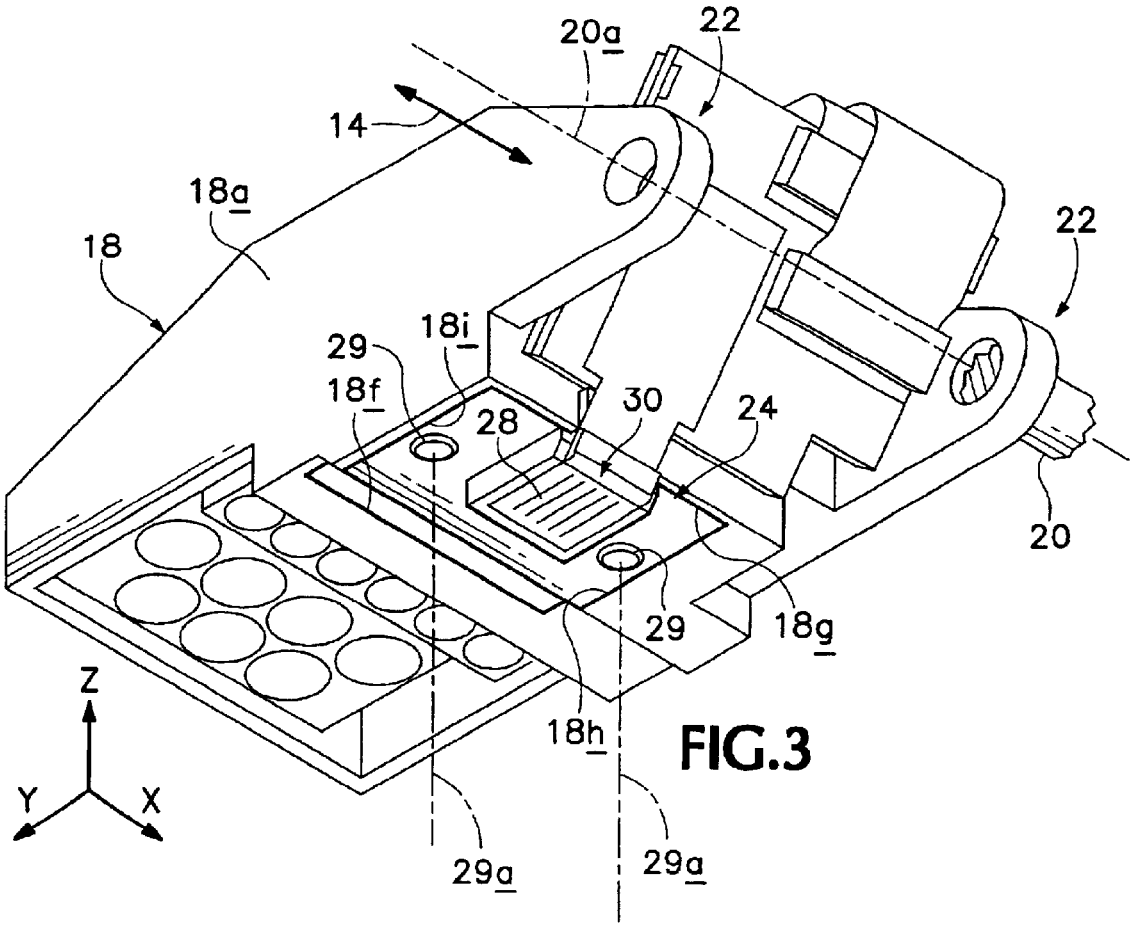
FIG. 3 is a bottom isometric view of the carriage, printhead carrier and ink-supply system of FIG. 2, on about the same scale employed in FIG. 2, and taken generally from the lower side of FIG. 2.
Figure 4:
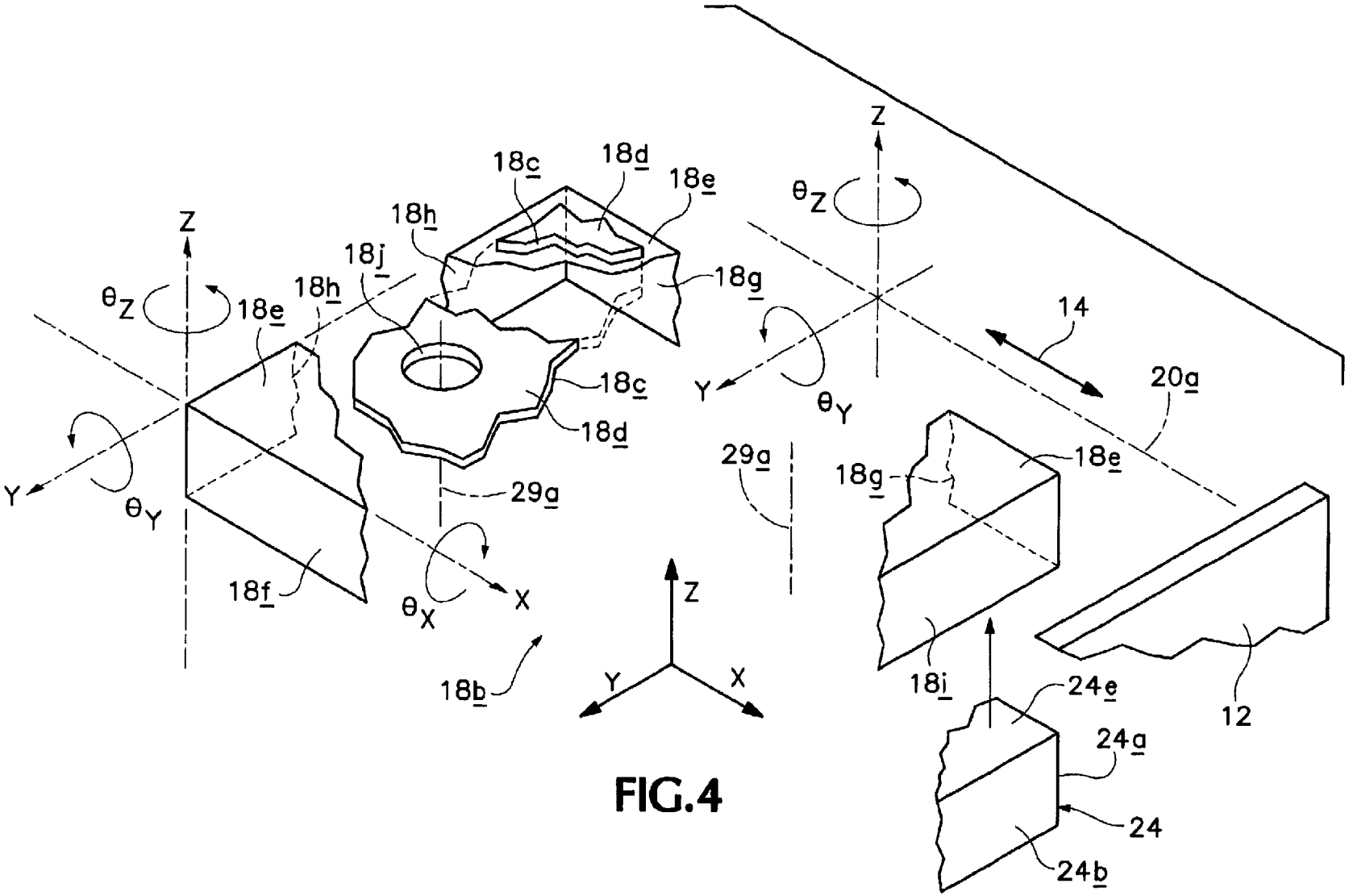
FIG. 4 is a larger-scale, fragmentary schematic diagram illustrating the structure and operation of a plural-axis datuming zone which exists in the mechanical connective interface between the printhead carrier and the body of the carriage in the printer of FIG. 1, including stylized planar representations of several datum surfaces which exist in a datuming socket that is formed on the underside of the carriage.

Focusing attention especially on FIGS. 2 and 4, and stating first a bit more about the nature of FIG. 4, FIG. 4 isolates certain surface structure in the interface region which exists between a carriage body and a printhead carrier. To do this, it utilizes several fragmentary imaginary planes which represent orthogonally-intersecting surfaces in a socket (shortly to be described) on the underside of the carriage. Also employed in FIG. 4 are fragments of certain physical, three-dimensional structure present in the carriage body and in the nozzle plate.

Thus, included in printer 10, and securely anchored and datumed on and with respect to carriage body 18*a* are a printhead carrier, or printhead carrier means 24, and an ink-supply system, or ink-supply means 26. A printhead 28 also is included, the printhead having a plurality of ink-dispensing nozzles configured to print on media passing through printzone 16. The printhead is mounted on the printhead carrier, but aligned relative the bearing structure as will be described further below. Ink supply system 26 is suitably fluidly connected to ink-dispensing nozzles of the printhead via printhead carrier 24. The printhead carrier thus will be seen to operate as an ink manifold between ink supply system 26 and the ink dispensing nozzles of printhead 28.

Printhead carrier 24 and ink-supply system 26 may be anchored in place through anchoring structure, such as bolts 29, which are also referred to herein as anchoring means. Bolts 29 typically extend through what is referred to as a mounting structure portion of carriage body 18*a* to form what is referred to herein as a sandwich structure, or sandwich means. Once such assembly is completed, typically during manufacture of the carriage, printhead 28 may be mounted on printhead carrier 24, and aligned directly relative to the carriage bearing structure. This alignment may be accomplished by any of a variety of precision alignment methods, including mechanical fixture systems, vision systems, laser systems, etc. For a vision alignment, it is to be noted that features for alignment may include the ink-dispensing nozzles of the printhead and the run axis of the bearing structure (which coincides, in the drawings, with axis 20*a*).

Typically, one important alignment between the carriage bearings and the printhead is θz alignment of the nozzles relative to the run axis of the bearings (the X axis). This alignment may significantly affect print quality due to potential skewing of vertical lines. Another issue addressed by proper θz alignment relates to maintaining column length of printhead nozzles. It will be appreciated that as a column of nozzles rotates, the length of the column decreases. Accordingly, from print swath to print swath, the tops and bottoms of the swaths may not mate along the Y axis, potentially causing a noticeable banding effect. Alignment of the printhead relative to the X axis, Y axis, θx, θy, and Z axis also may be accomplished. As will be appreciated, where the printhead is aligned directly to the carriage bearing structure, it may not be necessary to make further measurement alignment adjustments to the printhead upon placement of the carriage on the carriage rail.

Turning now to a discussion of datuming of the printhead carrier, it will be appreciated that the body of printhead carrier 24 may include a rectilinear portion 24*a* (see particularly FIG. 2), also referred to herein as a plural-axis-datuming datum-reference structure, and which functions as a docking structure, or docking means, that is received and plural-axially-datumed, in a rectilinear socket, or socket means 18*b*. Socket 18*b*, it will be noted, may be formed herein on the underside of carriage body 18*a*. Socket 18*b*, also called a plural-axis-datuming datum-reception site, along with docking structure 24*a* of the nozzle plate, collectively define a datuming zone. This datuming zone is referred to specifically as a single-region, plural-axis-datuming zone, which functions, according to one embodiment of the invention, as the single, datuming and connective interface between the carriage body and the printhead carrier. As will be explained, this datuming zone may be defined by pairs of contacting confronting surfaces, surface structure, or surface means, which function(s) as a collection of datum surfaces in the printhead carrier and socket. It will be appreciated that, for purposes of clarity, the term datuming is used herein to refer to alignment of the printhead carrier relative to the carriage because of the associated physical structure employed, but that such reference is not intended to be limiting in that sense.

In general terms, docking portion 24*a* of the printhead carrier has a rectilinear configuration defined by planar, orthogonally-related surfaces collectively occupying all respective pairs of intersecting reference axes X, Y and Z in the printer. In the printhead carrier, these orthogonally-intersecting surfaces may include (1) a pair of lateral-side surfaces which are spaced apart and which parallel one another, and one of which is shown at 24*b*, (2) a front surface 24*c*, (3) a rear surface 24*d*, and (4) an upper surface 24*e*. Surfaces 24*b* lie in spaced vertical parallel planes, each of which contains, effectively, reference axes Y and Z. Surfaces 24*c*, 24*d* lie in spaced parallel vertical planes, each of which contains, effectively, intersecting reference axes X and Z. With the printhead carrier mounted and datumed as shown on the body in the carriage, the nozzles in the subsequently-aligned printhead face downwardly toward printzone 16, as indicated generally at 30 in FIGS. 2 and 3.

The portion 18*c* of carriage body 18*a* which is sandwiched between the printhead carrier and the ink-supply system is also referred to herein as a mounting reception structural portion of the carriage body. This portion is generally planar, and typically includes an upper surface 18*d* and a lower surface 18*e*. Surface 18*e* typically faces downwardly toward the underside of the carriage body. Surfaces 18*d*, 18*e* each typically lie in a plane which contains reference axes X and Y. Surface 18*e* typically forms the upper, downwardly-facing, orthogonally-related datum surface in previously-mentioned socket 18*b*. Joining with downwardly-facing surface 18*e* in the carriage body to define datuming socket 18*b* are an upright front surface 18*f*, an upright rear surface 18*g*, and two laterally-spaced side surfaces 18*h*, 18*i*. All of the surfaces which make up the datuming socket on the underside of the carriage body may be formed with precision at the time that the carriage body is manufactured, and are completely integral with the carriage body.

With regard to ink-supply system 26, what is pictured generally in outline form in FIGS. 1 and 2 for this ink-supply system is what is referred to as an ink management hull. This hull may be suitably seated in appropriate receiving space provided for it within carriage body 18*a*. The undersurface portion, or at least a part of that undersurface portion, of the ink-supply system rests, and is supported, on carriage body surface 18*d*. It may be held in place, along with the printhead carrier, in the structure now being described by previously-mentioned, laterally-spaced bolts 29 which may be disposed on upright axes, shown by dash-dot lines at 29*a* in FIGS. 1–4, inclusive. The shanks in these two bolts may extend through suitable accommodating bores, such as bore 18*j* in carriage body portion 18*c* (see particularly the single bore 18*j* shown in FIG. 4). Bolts 29 may be tightened to draw the printhead carrier and the ink-supply system tightly into clamping engagement on opposite sides of mounting portion 18*c* of carriage body 18*a*, the ink-supply system effectively acting as a nut for receipt of bolts 29. This tightly-clamped arrangement creates the sandwich structure mentioned earlier, locks the ink-supply system into reliable, positional configurational relative to the printhead carrier. This datumed relationship addresses both translational and rotational datuming of the printhead carrier relative to reference axes X, Y, Z.

As indicated above, with the printhead carrier in place, printhead 28 may be mounted on the printhead carrier during manufacture, and datumed directly relative to the carriage bearing structure at that time. This, in turn, may provide reliable positioning of the printhead relative to media subsequently passing through the printzone. This effectively further reduces the tolerance stack of the printhead. Furthermore, because the printhead carrier is datumed separately a level of compatibility may be provided so as to provide for use of the proposed arrangement amongst a variety of differing printing devices.

Through appropriate pre-alignment and adjustment at the time of manufacturing of the carriage, the above-described datumed relationship may be established, and this established relationship may create plural-axis, accurate and configurationally-stable datuming between the printhead carrier and the carriage. Correspondingly, proper alignment may be achieved between the printhead and the carriage bearing structure upon attachment of the printhead to the printhead carrier, also at the time of manufacturing of the carriage. Accordingly, and through appropriate datuming which exists in the regions of previously-mentioned bearing structures 22, the printhead carrier is furnished with a single-region, plural-axis datuming interface to the reference axes (X, Y, Z) associated with frame 12. This datumed condition for the printhead carrier is a condition which effectively datums the printhead carrier not only translationally with respect to the three reference axes, but also rotationally with respect to the rotational considerations illustrated in several of the figures at θx, θy and θz. This statement about datuming, of course, recognizes that rail 20 allows for X-direction motion of the carriage during printing, as well as a certain amount of θx-rotation to deal with conventional printhead print-height considerations. In FIG. 4, associated with rail axis 20, two (Y and Z) of the three reference axes are shown, along with θy and θz. This has been done to point out that rail 20 furnishes only Y and Z datuming of carriage 18.

There thus results a unified, tightly-datumed structure which addresses many of the concerns expressed earlier regarding appropriate, reliable, multi-axis datuming and alignment, without coexistence of the tolerance-stack issue mentioned earlier. The provision of a multi-axial datuming socket on the underside of the carriage body is considered to be a good way of implementing both the structure and the method of the present invention, but we recognize that other datuming and alignment locations for multi-axial, six-degree-of-motion-datuming and alignment could be selected to suit different applications if so desired. It would be possible, for example, to form an integral carriage and printhead carrier, and to align the printhead relative to structure bearings at the time of manufacture, but such arrangement may reduce adaptability of the structure.

By clamping the printhead carrier along with the ink-supply system in an arrangement which sandwiches an intermediate portion of the carriage body, a very simple structure which can provide very simple and accurate datuming that will hold positional stability over a lifetime of printer use is provided. Such co-anchoring of the printhead carrier and the ink-supply system also tightly and reliably pre-positions these two, thus stabilizing the effectiveness and continuities of fluid paths which are provided for supplying ink to the nozzles in the printhead carrier from the ink-supply system. Mounting the printhead on the printhead carrier at the time of manufacture allows datuming of the printhead relative to the bearing structure, so as to reduce the tolerance stack.

The methodology which involves configurationally and stably aligning printhead nozzles in a printing device thus may be seen to include aligning the printhead relative to the bearing structure of the carriage, typically at the time of manufacture of the carriage. In the present embodiment, this is illustrated in the context of a carriage having a printhead carrier which is datumed with respect to the carriage of a printer, and wherein the carriage includes a datuming socket adapted to receive a docking portion of such a printhead carrier. This datuming may be accomplished by the steps of: (a) selecting surfaces in that socket to be datuming surfaces; (b) selecting surfaces in the docking portion of the printhead carrier also to be datuming surfaces; (c) orienting those datuming surfaces whereby confronting contact occurs between adjacent pairs of these surfaces which is effective to produce plural-axis datuming of the printhead carrier relative to the carriage; and (d) securely anchoring the printhead carrier to the carriage with the mentioned datuming surfaces contacting one another in a manner producing the mentioned plural-axis datuming. The method also includes effectively anchoring the printhead carrier to an ink-supply system that supplies ink to nozzles in the printhead carrier in such a fashion as to create a sandwich structure, with a portion of the carriage sandwiched tightly and securely between the printhead carrier and the ink-supply system. Thereafter, the printhead may be mounted on the printhead carrier in a secure manner, the printhead being aligned directly relative to the bearing structure.

In conclusion, an ink-dispensing printer, the stable alignment of ink-dispensing nozzles rotationally and translationally relative to the usual three X, Y and Z reference axes associated with the frame in the printer is a consideration that relates significantly to printing quality. The illustrated system proposes the implementation and use of structure and methodology which address this alignment consideration by providing for alignment of the printhead directly relative to the carriage bearing structure at the time of carriage manufacture without giving up on adaptability achieved through the use of a removable, replaceable and interchangeable printhead carrier. The printhead carrier is datumed by creating and employing a single-region, plural-axis datuming interface at a location which is intermediate a printhead carrier and the carriage body. In the datuming setting proposed, the printhead carrier is anchored to an associated ink-supply system which is also carried on the carriage. Anchoring takes place through structure that unites the printhead carrier and the ink-supply system in a clamping arrangement on opposite sides of a portion of the carriage body, thus to create a tight, stable sandwich assembly which includes the printhead carrier, the ink-supply system, and the body of the carriage. The printhead then may be mounted on the printhead carrier, and datumed directly relative to the carriage bearing structure.

While the invention has been particularly shown and described with reference to the foregoing preferred embodiments, those skilled in the art will understand that many variations may be made therein without departing from the spirit and scope of the invention as defined in the following claims. The description of the invention should be understood to include all novel and non-obvious combinations of elements described herein, and claims may be presented in this or a later application to any novel and non-obvious combination of these elements. Where the claims recite "a" or "a first" element or the equivalent thereof, such claims should be understood to include incorporation of one or more such elements, neither requiring nor excluding two or more such elements.

We claim:

1. A carriage for use in a printing device, the carriage comprising:

a body having bearing structure configured to support the carriage for movement along a reference track;

a printhead carrier anchored to the body and datumed relative to the body, both translationally and rotationally with respect to plural orthogonal reference axes; and a printhead anchored to the printhead carrier, and aligned directly relative to the carriage bearing structure.

2. A printing device comprising:

a frame;

a carriage rail anchored, and datumed relative, to the frame;

a printhead carrier including an integral, plural-axis-datuming datum-reference structure;

a carriage body mounted on, and datumed relative to, the carriage rail, and having bearing structure and an integral, plural-axis-datuming datum-reception site adapted to receive the printhead carrier;

anchoring structure configured to anchor the printhead carrier in a generally permanently stabilized condition to the carriage body with the datum-reference structure seated in stabilized contact with the datum-reception site, such anchored and stabilized seating fixedly datuming the printhead carrier relative to the carriage body; and at least one printhead mounted on the printhead carrier, and aligned relative to the bearing structure of the carriage body, wherein datuming the printhead carrier relative to the carriage body effects both translational and rotational datuming with respect to plural orthogonal reference axes.

3. The printing device of claim 2, wherein the datum-reception site defines a socket including at least three mutually orthogonally-related datum surfaces.

4. The printing device of claim 3, wherein the datum-reference structure defines three mutually orthogonally-related datum surfaces, each configured to confrontingly contact a different one of the datum surfaces of the datum-reception site with the printhead carrier anchored to the carriage body.

5. The printing device of claim 4, wherein each of the three datum surfaces is defined by an orthogonal reference axis.

6. The printing device of claim 2, wherein the printhead includes ink-dispensing nozzles, and which further comprises an ink-supply system configured for fluid connection to the nozzles and for mounting on the carriage body in a manner which, together with the printhead carrier, clamps on opposite sides of a mounting-reception structural portion formed integrally with the carriage body, the mounting-reception structural portion at least partially defining the datum-reception site, and collectively with the printhead carrier and the ink-supply system, forming a clamped, dimensionally-stable, sandwich structure.

7. A printing device comprising:

a moveable carriage body having bearing structure;

a printhead carrier anchored, and stabilized relative, to the carriage body through a single-region, plural-axis datuming zone configured to define a mechanical connective datuming interface between the carriage body and printhead carrier; and a printhead anchored to the printhead carrier, and aligned relative to the carriage bearing structure, wherein the datuming zone includes orthogonally related surface structure configured to furnish datuming capabilities that are both translational and rotational with respect to three mutually orthogonal axes.

8. The printing device of claim 7, wherein the printhead includes ink-dispensing nozzles, and which further comprises an ink-supply system fluidly connected to the nozzles, and anchored in a stabilized condition to the carriage body in a manner whereby the carriage body, printhead carrier, printhead and ink-supply system form a unified, stable, locked-together sandwich structure.

9. The printing device of claim 8, wherein the datuming zone defines a socket formed integrally in the carriage body with three mutually orthogonally-related datum surfaces, and the printhead carrier includes datum-reference structure with three mutually orthogonally-related datum surfaces, each configured for receipt within the socket to confrontingly contact a different one of the datum surfaces of the socket.

10. The printing device of claim 9, wherein the datuming zone is constructed to furnish the datuming capabilities via confronting contact between different pairs of datum surfaces.

11. A printing device comprising:

moveable carriage body means having bearing structure;

printhead carrier means anchored, and stabilized relative, to the carriage body means; and datuming means operatively interposed the carriage body means and the printhead carrier means in a region of anchoring therebetween for defining and providing a single-region, plural-axis datuming zone which functions as a full datuming interface between the carriage body means and the printhead carrier means; and printhead means anchored to the printhead carrier means in a positionally defined relationship relative to the bearing structure of the carriage body means, wherein the datuming means defines surface means for furnishing both translational and rotational datuming with respect to three mutually orthogonally related axes.

12. The printing device of claim 11, wherein the datuming means includes socket means formed in the carriage body means and docking means formed in the printhead carrier means for anchored receipt within the socket means.

13. The printing device of claim 12, wherein the socket means is formed on an underside of the carriage body means.

14. In a printing device including a frame with respect to which there are associated three mutually orthogonally-related reference axes, datuming apparatus comprising:

a carriage body having bearing structure and defining a rectilinear datuming socket formed integrally on an underside thereof, the socket defining at least three mutually orthogonally related planar surfaces, each of which corresponds with two of the reference axes;

a printhead carrier including integrally-formed, rectilinear, datuming docking structure received within the socket and including at least three mutually orthogonally related planar surfaces which bear confrontingly, on a one-to-one basis, with one each of the at least three mutually orthogonally related planar surfaces of the socket, such datumed reception creating a stable, all-degree-of-relative-motion, locked, datumed relationship between the carriage body and the printhead carrier;

an ink-supply system fluidly connected to the printhead carrier, and mounted on the carriage body in a manner which, together with the printhead carrier, forms a sandwich structure with a portion of the carriage body interposed the printhead carrier and the ink-supply system;

anchoring structure extending through the portion of the carriage body interposed the printhead carrier and the ink-supply system to anchor the printhead carrier and the ink-supply system to the sandwich structure in a condition with the printhead carrier and the ink-supply system drawn in fixed relationship against opposite sides of the portion of the carriage body interposed the printhead carrier and the ink-supply system; and a printhead having a plurality of nozzles, the printhead being anchored to the printhead carrier with the nozzles in fluid communication with the ink-supply system via the printhead carrier, such printhead being aligned directly relative the carriage body bearing structure.

15. A method of aligning a printhead relative to a print-zone in a printing device wherein the printing device includes a carriage mounted in the printing device via bearing structure for movement along a reference track, the method comprising:

selecting surfaces of a carriage body to be carriage body datuming surfaces;

selecting surfaces of a printhead carrier to be printhead carrier datuming surfaces;

orienting the carriage body datuming surfaces relative to the printhead carrier datuming surfaces whereby confronting contact between adjacent pairs of such datuming surfaces will be effective to produce translational and rotational datuming of the printhead carrier relative to the carriage body with respect to plural orthogonal reference axes;

anchoring the printhead carrier to the carriage body, with the datuming surfaces contacting one another; and mounting a printhead on the printhead carrier with the printhead aligned relative to the carriage bearing structure upon such mounting.

16. A method of assembling a carriage for use in a printing device, wherein the carriage includes a carriage body mounted for movement along a reference track via bearing structure, the method comprising:

datuming a printhead carrier relative to the carriage body;

datuming an ink-supply system relative to the carriage body in fluid communication with the printhead carrier;

anchoring the printhead carrier to the ink-supply system with the carriage body intermediate the printhead carrier and the ink-supply system;

mounting a printhead on the printhead; and aligning the printhead relative to the carriage bearing structure upon mounting the printhead on the printhead carrier.

* * * * *